US006227741B1

(12) United States Patent
Quercioli

(10) Patent No.: US 6,227,741 B1
(45) Date of Patent: May 8, 2001

(54) FELT PEN OR LIKE WRITING INSTRUMENT AND MANUFACTURING PROCESS THEREFOR

(75) Inventor: Enrico Quercioli, Settimo Torinese (IT)

(73) Assignee: Universal S.p.A., Turin (IT)

( * ) Notice: Subject to any disclaimer, the term of this patent is extended or adjusted under 35 U.S.C. 154(b) by 0 days.

(21) Appl. No.: 09/383,184

(22) Filed: Aug. 26, 1999

(30) Foreign Application Priority Data

Jul. 5, 1999 (EP) ..... 99830278

(51) Int. Cl.[7] ..... B43K 5/00
(52) U.S. Cl. ..... 401/199; 401/198
(58) Field of Search ..... 401/198, 199, 401/196, 205, 202

(56) References Cited

U.S. PATENT DOCUMENTS

| | | | | |
|---|---|---|---|---|
| 3,397,939 | | 8/1968 | Berry . | |
| 4,531,853 | * | 7/1985 | Hirabayashi et al. | 401/265 |
| 5,865,553 | * | 2/1999 | Flye Sainte et al. | 401/199 |
| 5,906,446 | * | 5/1999 | McCullock et al. | 401/199 |

FOREIGN PATENT DOCUMENTS

| | | | | |
|---|---|---|---|---|
| 1250302 | * | 9/1967 | (DE) | 401/199 |
| 4231978A | | 3/1994 | (DE) . | |
| 0 516 538 | | 5/1992 | (FR) . | |
| 1039667 | * | 7/1966 | (GB) | 401/198 |
| WO 98/21052 | | 5/1998 | (WO) . | |

* cited by examiner

*Primary Examiner*—Gregory L. Huson
*Assistant Examiner*—Huyen Le
(74) *Attorney, Agent, or Firm*—Sughrue, Mion, Zinn, Macpeak & Seas, PLLC

(57) ABSTRACT

A felt pen or a like writing instrument includes an elongate body having a cavity defining a first chamber housing a plug of hydrophilic material associated with a writing tip one end of which projects out of the body. The body also includes a second chamber separated from the first chamber and defining a reservoir for liquid ink for supplying the writing tip. The writing tip is spaced from the second chamber and can be supplied with ink directly from the-plug which draws ink from the reservoir through capillary supply means independent of the writing tip and interposed between the first and the second chambers.

3 Claims, 3 Drawing Sheets

31
33
3a
5
27
29
26
1
4
25
20
16
24
22
3
18
15
14
9
3b
12
10
7
9a

FELT PEN OR LIKE WRITING INSTRUMENT AND MANUFACTURING PROCESS THEREFOR

BACKGROUND OF THE INVENTION

The present invention relates to writing instruments having a writing tip supplied with fluid ink, such as felt pens and the like.

More specifically, the invention relates to a felt pen or like writing instrument comprising an elongate hollow body in which there is defined a first chamber for housing a plug of hydrophilic material associated with a writing tip one end of which projects externally from the body, and a second chamber separated from the first chamber, which defines a liquid ink reservoir for supplying the writing tip.

A writing instrument of the type defined above is the subject of European Patent Application EP-516538. The writing tip of the writing instrument described in this document is long so that it passes through a significant portion of the body, having a writing end which projects externally from the body and an opposite end which extends into the second chamber, which constitutes the liquid ink reservoir. As a result of this construction of the writing tip, the liquid ink is supplied directly to the writing tip from the reservoir. A tubular plug is also associated with the writing tip, arranged in the first chamber, in an intermediate position between the writing end of the tip and the second chamber, which the tip passes through from one end to the other. The function of the plug is to absorb any excess ink from the reservoir, should the air in the reservoir heat up, causing excess pressure to build up, and to pass on this stored ink to the writing tip once normal operating conditions are restored. In practice, this tubular plug acts as a temporary ink store only when the main reservoir causes excess ink to flow to the writing tip.

However, the structure of the writing instrument described in this earlier document has several disadvantages. Firstly, since in the most common arrangement the writing tip is made up of a bundle of parallel fibres extending axially with respect to the writing tip itself, these fibres act to allow ink to flow in a predominately axial direction, whereby the arrangement of a plug which surrounds radially the writing fibre is found to hamper the exchange of ink between the fibre and the plug. In practice, the ink tends preferably to flow along the writing tip even if excess pressure has built up in the liquid-ink reservoir, with the result that under such circumstances ink tends to drip from the end of the writing tip rather than accumulating temporarily in the plug. In addition, the manufacture of a rectilinear writing tip which is sufficiently long to project from the body at one end and extend into the ink reservoir at the other, and that of a tubular plug, as well as the operation involved in axially inserting the writing tip into the plug, pose technological problems which cannot be solved both reliably and inexpensively at the same time.

SUMMARY OF THE INVENTION

In order to resolve the disadvantages described above, the object of the present invention is a pen or similar writing instrument of the type defined at the beginning of this description, characterised in that the writing tip is spaced from the second chamber and is intended to be supplied with ink directly from the plug, ink having been fed to the plug from the reservoir by means of capillary supply means independent of the writing tip and interposed between the first and second chambers.

As a result of this arrangement, the writing instrument of the invention is entirely reliable in operation and is simple and relatively inexpensive to manufacture. In particular, the working of the instrument is based on a different principle from that described in the aforesaid document with reference to the prior art, since the writing tip of the instrument of the present invention is always supplied with ink directly from the plug. In turn, the plug receives ink by capillary action from the reservoir constituted by the second chamber, as the ink absorbed by it is reduced through use of the writing instrument.

A further object of the invention is to provide a process for manufacturing a felt pen or similar writing instrument, as indicated in the appended claim 13.

BRIEF DESCRIPTION OF THE DRAWINGS

Further characteristics and advantages of the invention will become clearer from the following detailed description, supplied purely by way of non-limitative example and with reference to the appended drawings, in which.

DETAILED DESCRIPTION OF THE INVENTION

Figure 1:
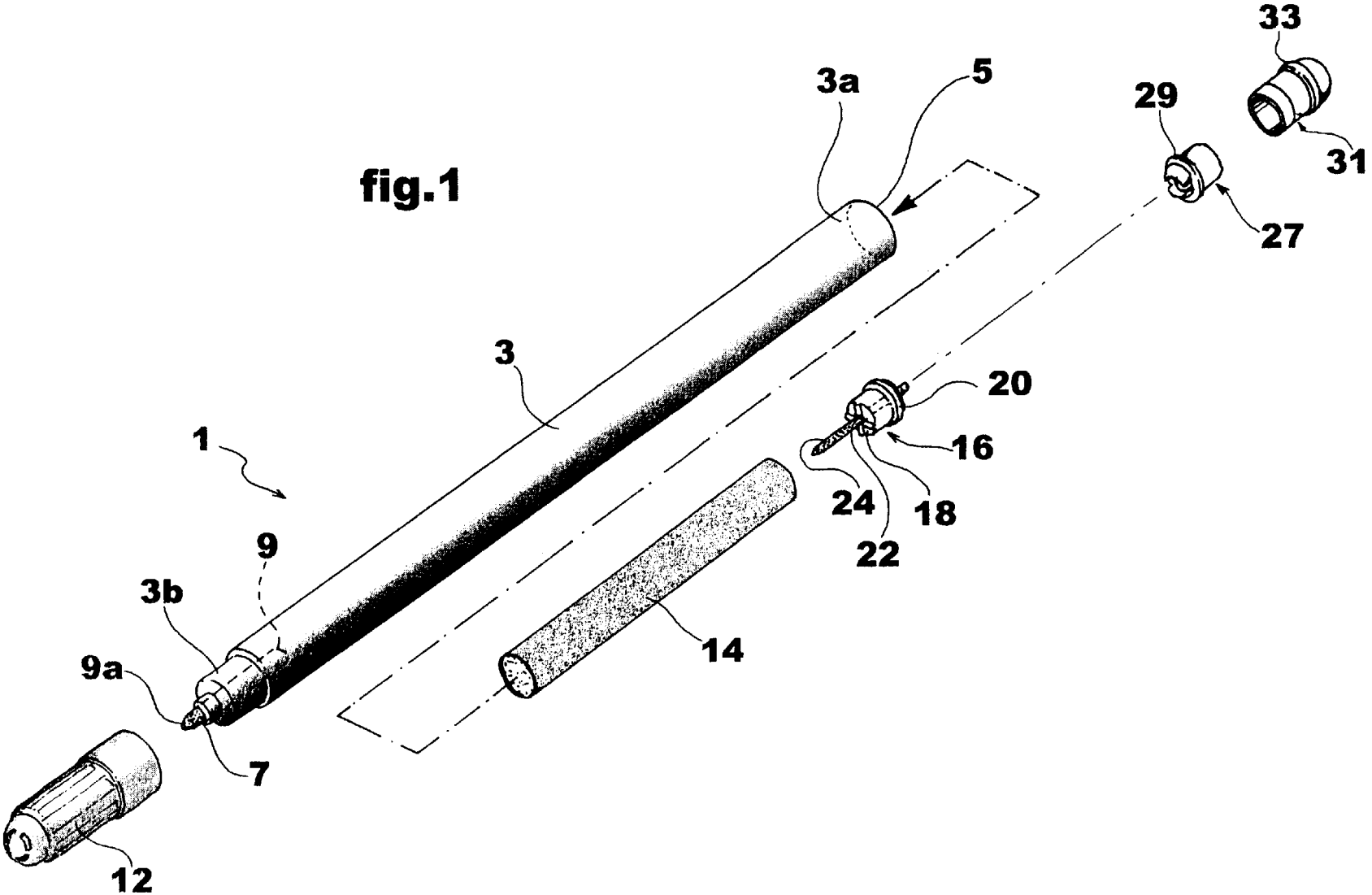
FIG. 1 is an exploded perspective view of a writing instrument of the invention.
Figure 2:
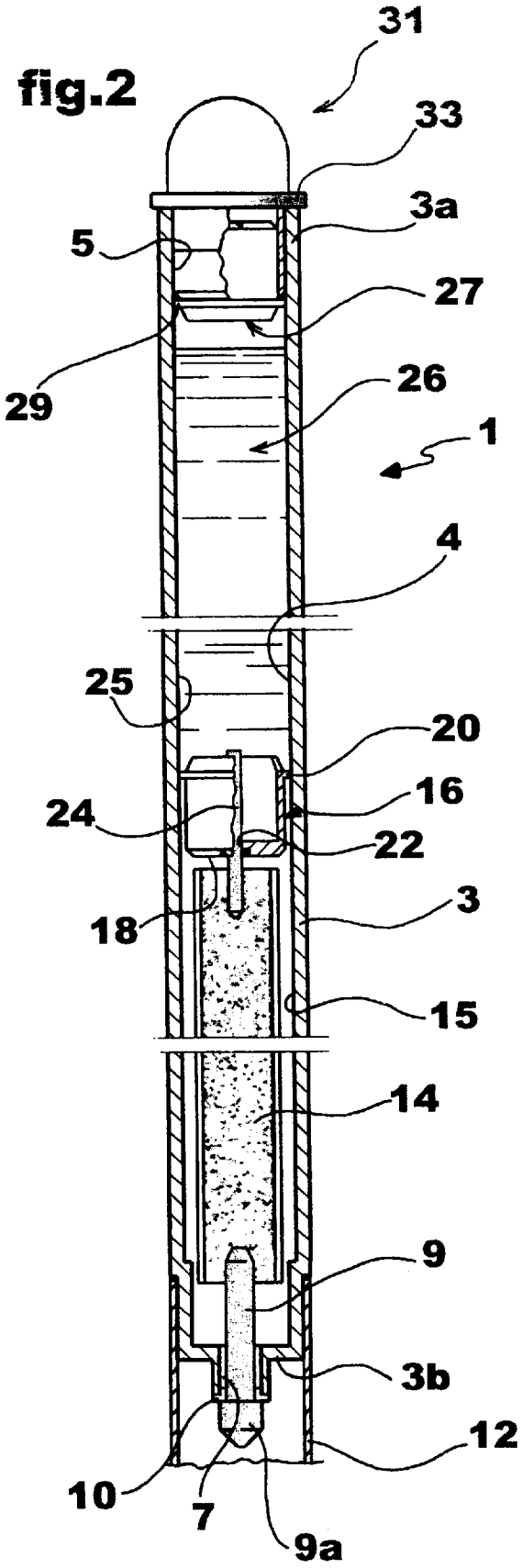
FIG. 2 is a sectioned side elevation view of the instrument of FIG. 1, in its assembled condition.

With reference first to FIGS. 1 and 2, a felt pen or similar writing instrument according to the invention is generally indicated 1.

The instrument 1 comprises an elongate hollow body 3, having a preferably cylindrical cavity delimited by an internal surface 4 of the body 3 which extends between a first end 3*a* and a second, opposite end 3*b*.

The end 3*a* opens to the exterior through an aperture 5 of a shape corresponding to the cross section of the cavity of the body 3, while the end 3*b* has a generally narrow axial. aperture 7, for housing in a known manner a writing tip 9 having a writing end 9*a* which projects out from the body 3. The tip 9 may be of any type, a fibre tip for example or a so-called "roller ball" or ballpoint having a ball in correspondence of its writing end.

In particular, the narrow opening 7 is shaped so as to define a plurality of aeration channels 10 between itself and the tip 9, for the passage of air towards the cavity of the body 3.

In addition, the exterior of the end 3*b* is shaped so as to engage a cap 12 of a type known per se.

A cylindrical plug 14 of hydrophilic material, shorter than the length of the cavity of the body 3, the plug 14 being, for example, around half the length of the cavity, is connected to the end of the writing tip 9 opposite the writing end 9*a*, so as to occupy only a portion of the cavity of the body 3, near the end 3*b*. Preferably, between the internal surface 4 of the body 3 and the radially external surface of the plug 14, there is a space in communication with the channels 10 so as to enable air to circulate.

A transverse partition 16 is arranged near the end of the plug 14 opposite the writing tip 9 for delimiting a first chamber 15 for housing the plug 14 and for constituting a transverse diaphragm which sealably closes the chamber 15 on one side and the remaining portion of the cavity of the body 3 on the other. The partition 16 is preferably cup-shaped, with a bottom 18 substantially fulfilling a role as shoulder for the corresponding end of the plug 14.

In order to provide an effective seal, the partition 16 has at least one annular rib 20 projecting radially therefrom and intended to be deformed slightly as a result of radial interference with the wall 4. In order to provide a more effective seal, there could, naturally, be more ribs 20, a pair for example, slightly spaced axially along the radially outward surface of the partition 16.

A central axial hole 22 is formed at the bottom 18 of the partition 16 in order to sealably insert a cylindrical element 24 of preferably fibrous capillary material, one end thereof partly penetrating inside the plug 14, with the opposite end thereof, on the other side of the partition 16, facing a second chamber 25 which extends from the partition 16. The chamber 25 is intended to store a predetermined quantity of liquid ink 26.

An end closure member 27 is arranged at the end 3*a* of the body 3 for sealably closing the chamber 25 from the external environment. Advantageously, the member 27 is cup-shaped, exactly like the partition 16 except that there is no central aperture in this case, and is mounted the other way up from the partition 16. The member 27 also has an annular rib 29, like the rib 20 of the partition 16, in order to provide a radial seal by interference with the wall 4 of the cavity of the body 3. It is convenient if the closure member 27 has an auxiliary stopper 31 for holding the member 27 in place, as once assembled this partially protrudes outside the end 3*a* of the body 3. The stopper 31 has a radial collar 33 operable to bear frontally against the end 3*a* so as to form an end stop for the member 27 when it is inserted into the cavity of the body 3.

At least part of the body 3, at the site of the chamber 25, is preferably made of a transparent material in order to enable the user to see the level of ink 26 in the said chamber.

In order to manufacture a writing instrument 1, first the hollow body 3 is made and then the writing tip 9, the plug 14, the capillary element 24, the partition 16 and the end-closure member 27 are all prepared separately. When preparing the partition 16, a substantially central hole 22 is formed in the bottom 1 through which to insert the capillary element 24.

The writing tip 9 is also inserted into the body 3 by the narrow end 3*b*. Thanks to the fact that the tip 9 is independent of the internal structure of the body 3, any writing tip which can be supplied from a plug of hydrophilic material, a thick tip, a fine tip or a roller ball, can be used with the same body structure 3, so that the structure of the writing instrument of the invention is especially versatile.

The body 3 fitted with the writing tip 9 is then fed to a, preferably automatic, machine which inserts first the plug 14 and then the partition 16 and the capillary element 24 through the aperture 5 in the end 3*a*, by means of a pusher element, not shown in the drawings. Following this operation, the plug 14 is moved into a position in which it is partially penetrated by the end of the writing tip 9 opposite the writing end 9*a*, while at the opposite end it is partially penetrated by the capillary element 24 adjacent the partition 16, the shoulder 18 substantially bearing against the latter end of the plug 14.

Once the partition 16 has been forced into the cavity of the body 3, the rib 20 is slightly deformed as a result of radial interference;with the wall 4, thereby ensuring an optimal seal. An injector then fills the chamber 25 at the other end of the plug 14 from the partition 16 with a predetermined quantity of ink 26, a few grams of ink for example. Once the reservoir constituted by the chamber 25 has been filled, it is sealably closed by forcibly inserting into the end 3*a* the assembly made up of the closure member 27 and the auxiliary stopper 31 until the collar 33 bears against the end 3*a*.

Once the manufacturing process of the instrument 1 is complete, partly as a result of the pressure built up in the chamber 25 by the insertion of the closure member 27, the ink 26 begins to flow into the plug 14 through the capillary element 24, and from the plug 14 to the writing tip 9.

Figure 3:
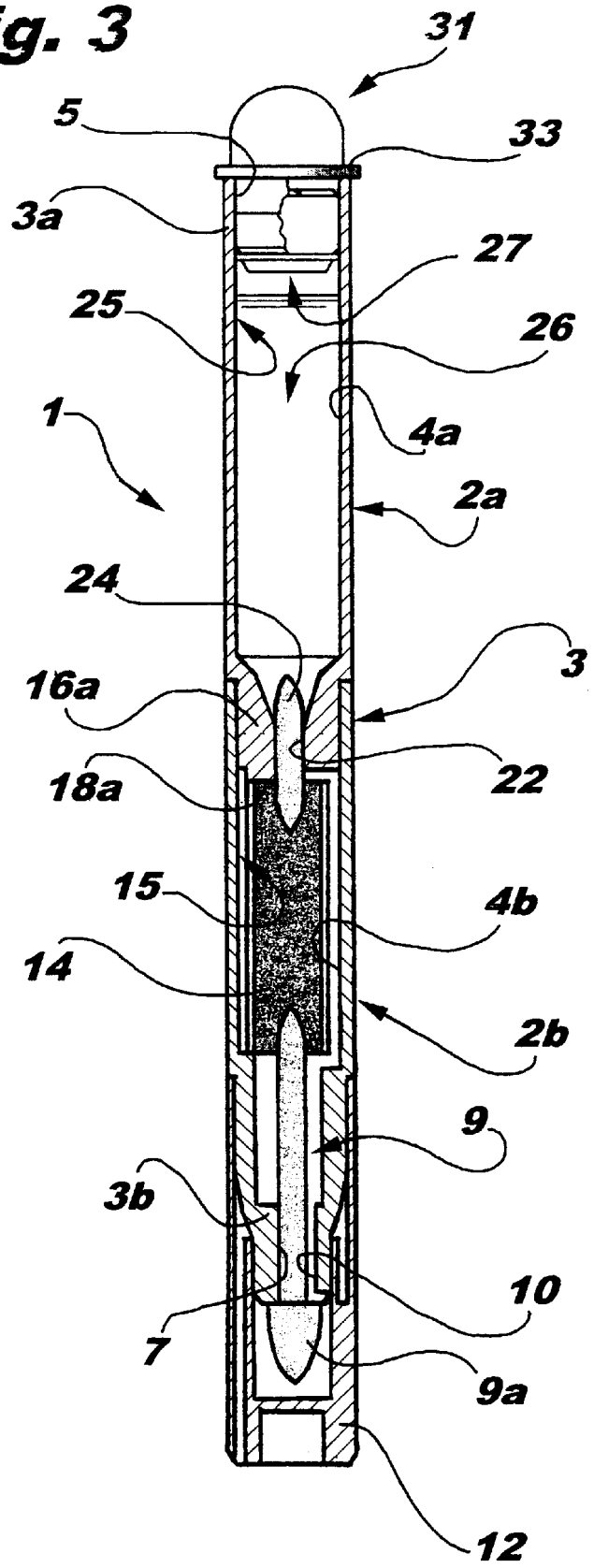
FIG. 3 is a view similar to FIG. 2 of a variant of the writing instrument according to the invention.

With reference to the variant illustrated in FIG. 3 in which the same reference numerals have been utilised to indicate the same or similar parts to those of the Figures described above, the body 3 of the instrument 1 comprises two parts 2*a* and 2*b* of similar structure connected together.

The parts 2*a* and 2*b* each comprise a tubular wall having a respective internal surface 4*a*, 4*b* which terminates at one end with a narrow portion. The end portion of the part 2*a*, indicated 16*a* and to which the element 24 of capillary material is connected, acts as a partition to isolate the ink 26 contained in the chamber 25 from the chamber 15 of the part 2*b*. Moreover, the part 2*a* has a surface 18*a* facing towards the chamber 15 of the part 2*b*, acting as a shoulder for the plug 14. The end portion 3*b* of the part 2*b* receives the writing tip 9 as in the previously-described case.

The two parts 2*a* and 2*b* are preferably prepared separately, that is the part 2*a* is provided with the capillary element 24 and the part 2*b* is equipped with the writing tip 9 and the plug 14.

After having separately prepared the parts 2*a* and 2*b* they are coupled together by utilising a coupling system known per se. Conveniently, after having inserted the portion 16*a* of the part 2*a* into the part 2*b*, at the opposite end from its portion 3*b*, the body 3 thus formed is subjected to an ultrasonic or friction welding process in such a way as to connect the parts 2*a* and 2*b* together definitively.

Finally, the chamber 25 of the part 2*a* is filled with a metered quantity of ink 26 and closed by means of the closure member 27.

Thanks to the structure of the writing instrument according to the present variant, the body 3 can be made in a particularly simple and reliable manner utilising, at least for the preparation of the individual parts 2*a* and 2*b*, machines normally used for the manufacture of felt pens of conventional type. Moreover, the structure of the present variant makes it possible to facilitate the production of that part of the body 3 in correspondence with the chamber 25 as a transparent part to allow the level of liquid ink 26 to be seen in that, for this purpose, it is sufficient to make the entire part 2*a* of a transparent plastics material.

While the instrument 1 is being used, the ink impregnating the plug 14 is drawn by capillary effect into the writing tip 9. When the plug 14 starts to run out of ink, it draws ink by capillary effect from the element 24. The channels defined by the fibres of the element 24 begin to empty of ink, leaving spaces for air present in the chamber 15 and in the plug 14 to pass through the element 24 into the chamber 25, thereby compensating for a pressure drop caused in the chamber 25 following the withdrawal of ink 26 by the plug 14, and perhaps causing more ink 26 to flow through the capillary element 24 to the plug 14 and thus to supply the writing tip 9.

What is claimed is:

1. A felt pen comprising an elongate hollow body having first and second chambers separated by a partition member which provides an effective seal between the chambers, a plug of absorbent material disposed in said first chamber in spaced relation to said hollow body to define an air space around said plug, an elongated cylindrical element of capillary material sealingly extending through an aperture in said partition with one end partially penetrating an end of said plug adjacent said partition and an opposite end extending into said second chamber, a felt writing tip extending through an opening in an end of said first chamber remote from said partition and partially penetrating an opposite end of said plug, aeration channels disposed between said writing tip and said opening in communication with said air space and closure means for closing an end of said second chamber remote from said partition for sealingly containing a supply of ink in said second chamber, wherein said partition member comprising a cup-shaped element having a radially projecting annular rim disposed in sealing engagement with said hollow body and a bottom portion disposed adjacent said plug.

2. A felt pen as set forth in claim 1, wherein said hollow body is comprised of two parts and said partition is integrally formed with one part and disposed in engagement with the other part.

3. A felt pen according to claim 2, wherein said parts of the body have a similar shape and each comprises a tubular wall provided at one end with a narrow portion for housing said cylindrical element of capillary material and the writing tip respectively.

* * * * *